US007757396B2

(12) United States Patent
Sawada et al.

(10) Patent No.: US 7,757,396 B2
(45) Date of Patent: Jul. 20, 2010

(54) RAW MATERIAL POWDER FOR LASER CLAD VALVE SEAT AND VALVE SEAT USING THE SAME

(75) Inventors: Toshiyuki Sawada, Himeji (JP); Akihiko Yanagitani, Himeji (JP); Shingo Fukumoto, Himeji (JP); Tomoki Okita, Wako (JP); Takashi Tsuyumu, Wako (JP); Makoto Asami, Wako (JP); Nobuki Matsuo, Tochigi-Ken (JP); Shogo Matsuki, Tochigi-Ken (JP); Yoshitaka Tsujii, Tochigi-Ken (JP)

(73) Assignees: Sanyo Special Steel Co., Ltd., Hyogo-Ken (JP); Honda Motor Co., Ltd., Tokyo (JP)

( * ) Notice: Subject to any disclaimer, the term of this patent is extended or adjusted under 35 U.S.C. 154(b) by 544 days.

(21) Appl. No.: 11/881,396

(22) Filed: Jul. 26, 2007

(65) Prior Publication Data

US 2008/0083391 A1 Apr. 10, 2008

(30) Foreign Application Priority Data

Jul. 27, 2006 (JP) ..... 2006-204328
Apr. 23, 2007 (JP) ..... 2007-112691

(51) Int. Cl.
*F01L 3/04* (2006.01)

(52) U.S. Cl. ..... 29/888.44; 251/359; 251/368

(58) Field of Classification Search ..... 251/359, 251/368; 29/888.44, 890.122; 427/456, 427/455, 451, 450; 428/698, 699
See application file for complete search history.

(56) References Cited

U.S. PATENT DOCUMENTS 4,269,391 A * 5/1981 Saito et al. ..... 251/368
4,346,684 A * 8/1982 Vossieck ..... 29/888.44
4,424,953 A * 1/1984 Takagi et al. ..... 251/368

(Continued)

FOREIGN PATENT DOCUMENTS

| | | |
|---|---|---|
| EP | 0939139 A2 | 9/1999 |
| JP | 63-157826 | 6/1988 |
| JP | 2748717 | 2/1998 |
| JP | 2004-162100 | 6/2004 |
| JP | 2005199278 A | 7/2005 |
| JP | 2005297051 A | 10/2005 |

*Primary Examiner*—John Bastianelli
(74) *Attorney, Agent, or Firm*—The Webb Law Firm

(57) ABSTRACT

There are disclosed a laser clad valve seat raw-material powder superior in productivity, cladding property, wear resistance and finishing property, and a laser clad valve seat using the same superior in wear resistance. The row-material powder comprises a powder mixture comprising: 80 to 99% by weight of a Cu-based alloy powder comprising 0.5 to 5% by weight of B, 0 to 20% by weight of Ni, 0 to 10% by weight of Fe plus Co, 0 to 5% by weight of Si, 0 to 3% by weight of Al, and the balance Cu and unavoidable impurities; and 1-20% by weight of an Fe or Co based alloy powder having a Vickers hardness of 500 HV or higher and an average particle diameter of 50 to 200 μm of and comprising 5 to 40% by weight of Mo, 0 to 25% by weight of Cr, 0 to 5% by weight of Si, and the balance Fe or Co and unavoidable impurities.

11 Claims, 1 Drawing Sheet

U.S. PATENT DOCUMENTS 4,818,307 A 4/1989 Mori et al.
5,803,037 A * 9/1998 Kawamura et al. ..... 251/360
6,372,346 B1 * 4/2002 Toth ..... 428/698
7,040,601 B2 * 5/2006 Chikahata et al. ..... 251/368
2005/0034700 A1 * 2/2005 Clause et al. ..... 29/890.122
2006/0108029 A1 5/2006 Kawasaki et al.

* cited by examiner

RAW MATERIAL POWDER FOR LASER CLAD VALVE SEAT AND VALVE SEAT USING THE SAME

CROSS-REFERENCES TO RELATED APPLICATIONS

This application claims priorities to Japanese Patent Application No. 204328/2006 filed on Jul. 27, 2006 and Japanese Patent Application No. 112691/2007 filed on Apr. 23, 2007, the entire disclosures of which are incorporated herein by reference.

BACKGROUND OF THE INVENTION

1. Field of the Invention

This invention relates to a raw material powder for a laser clad valve seat superior in productivity, cladding property, wear resistance, and finishing property, and also relates to a valve seat using this raw material powder.

2. Background Art

Conventionally, Fe based powder sintered materials are mainly used for valve seats employed in vehicle engines or the like. The valve seat is pressed into the cylinder head to inhibit a wear caused by the valve. In recent years, there have been suggested techniques for a laser clad valve seat of a copper alloy having a radiating property and a thin-wall property superior to those of such a sintered valve seat, as is described in the following documents, for example.

Japanese Patent Laid-Open Publication No. 162100/2004 discloses a cladding copper alloy powder comprising, by weight, 8.0 to 20.0% of Ni, 1.5 to 4.5% of Si, a total of 2.0 to 15.0% of at least one of Fe, Co and Cr, and a total of 0.1 to 1.5% of at least one of Mm (Misch metal), P and Ti, with the balance Cu and unavoidable impurities.

Japanese Patent Publication No. 942/1996 discloses a dispersion strengthened Cu based alloy superior in wear resistance, comprising, by weight, 5 to 30% of Ni, 1 to 5% of Si, 0.5 to 3% of B, and 4 to 30% of Fe, with the balance Cu and unavoidable impurities, and having a structure such that particles of Fe—Ni based silicide and boride are dispersed in a Cu based matrix.

Japanese Patent Publication No. 2748717 discloses a cladding, wear-resistant, copper based alloy comprising, by weight, 10 to 30% of Ni, 1 to 5% of Si, and 2 to 15% of Fe with the balance Cu and unavoidable impurities and having a structure such that a hard layer of Fe—Ni based silicide is finely dispersed in a Cu—Ni alloy having uniformly fine dendrite.

However, none of the alloys disclosed in the documents exhibits satisfactory wear resistance, even in particular use under environments where adhesive wear is apt to occur intensively, nor it indicates superior performance in productivity, cladding property, and finishing property.

SUMMARY OF THE INVENTION

The inventors have now found that, when a powder mixture of a Cu based alloy powder comprising a certain amount of B and a Fe or Co based alloy powder comprising a certain amount of Mo in a predetermined ratio is melted with laser or the like and then solidified, the resulting product exhibits satisfactory wear resistance even in particular use under environments where adhesive wear is apt to occur intensively, while also exhibiting superior performance in productivity, cladding property, and finishing property. Therefore, the inventors have also found that a laser clad valve seat superior in wear resistance can be provided.

Accordingly, it is an object of the present invention to provide a raw material powder for a laser clad valve seat superior in productivity, cladding property, wear resistance, and finishing property, and a laser clad valve seat using this raw material powder superior in wear resistance.

According to the present invention, there is provided a raw-material powder for a laser clad valve seat, comprising a powder mixture of:

a Cu based alloy powder of 80 to 99% by weight of the powder mixture comprising:

B: 0.5 to 5% by weight,

Ni: 0 to 20% by weight,

Fe plus Co: 0 to 10% by weight,

Si: 0 to 5% by weight,

Al: 0 to 3% by weight, and the balance Cu and unavoidable impurities; and an Fe or Co based alloy powder of 1 to 20% by weight of the powder mixture, having a Vickers hardness of 500 HV or higher and an average particle diameter of 50 to 200 μm and comprising:

Mo: 5 to 40% by weight,

Cr: 0 to 25% by weight,

Si: 0 to 5% by weight, and the balance Fe or Co and unavoidable impurities.

According to the present invention, there is also provided a laser clad valve seat comprising a laser clad layer formed by laser-cladding with the powder mixture.

DETAILED DESCRIPTION OF THE INVENTION

The present invention will be described below in detail.

Laser Clad Valve Seat Raw-material Powder

Figure 1A:
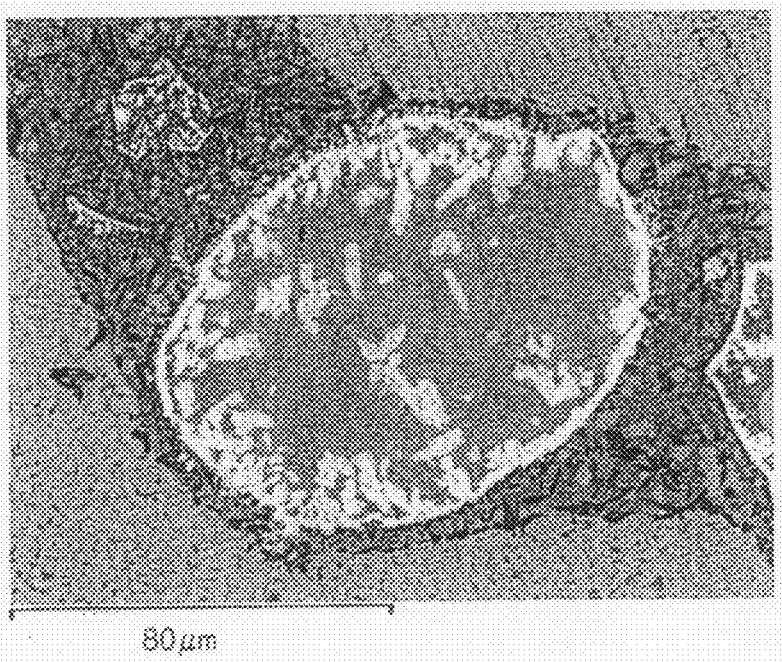
FIG. 1A is an optical microscope photograph of the hard particles of the powder mixture according to the present invention.
Figure 1B:
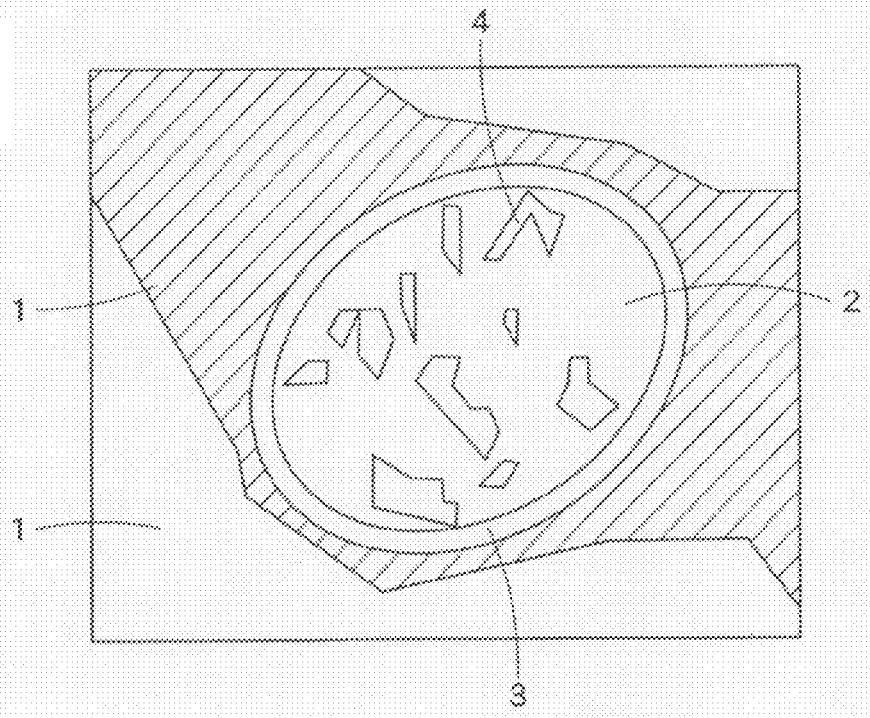
FIG. 1B is a schematic diagram of FIG. 1A, in which reference numeral 1 denotes a base phase mainly comprising a Cu based alloy powder, reference numeral 2 denotes a hard phase mainly comprising an Fe or Co based alloy powder, reference numeral 3 denotes Mo based boride in a shell shape, and reference numeral 4 denotes Mo based boride resulting from diffusion of B into the Co based alloy powder.

The laser clad valve seat raw-material powder of the present invention comprises a powder mixture of a Cu based alloy powder superior in cladding property comprising predetermined amounts of B and other optional components (Ni, Fe, Co, Si and Al) (hereinafter referred to as "Cu based alloy powder"), and an Fe or Co based alloy powder with a high hardness comprising predetermined amounts of Mo and other optional components (Cr and Si) (hereinafter referred to as "Fe or Co based alloy powder"). By melting and solidifying the powder mixture with laser or the like, boron (B) in the Cu based alloy powder reacts with molybdenum (Mo), which tends to produce boride easily in the Fe or Co based alloy powder, at the interface of the Fe or Co based alloy powder to form an Mo based boride, resulting in hard particles with a shell structure as shown in FIGS. 1A and 1B. FIG. 1A is a reflection electron image and FIG. 1B is a schematic diagram of FIG. 1A. That is, it is the most important feature of the present invention that coarse hard particles with a shell structure are obtained by mixing together the Cu based alloy powder comprising B and the Fe or Co based alloy powder comprising Mo and then melting and solidifying the powder mixture with a laser cladding technique. The feature will be described in more detail in the following items (1) to (5).

(1) The Mo based boride to be produced has a lubricating action under a wearing environment. Although the details on the lubricating action are uncertain, this is believed to be because the Mo and B oxides produced in oxidizing atmosphere inhibit the adhering of wear debris on both the valve and the surface of the valve seat. This lubricating action allows the raw-material powder to have a satisfactory wear resistance even under an extremely intense environment of adhesive wear as described above.

(2) When the Mo and B to form the Mo based boride are contained in the respective powders and melted, the Mo based boride forms mainly on the interface, so as to form a shell structure in which the Mo based boride surrounds a hard phase mainly comprising the components of the Fe or Co based alloy powder. In addition, part of the B diffuses into the Fe or Co based alloy powder so as to form the Mo based boride. Accordingly, as shown in FIGS. 1A and 1B, the raw-material powder has a structure in which the Mo based boride surrounds the hard phase mainly comprising the Fe or Co based alloy powder and a coarse particle mixture of a Mo based boride formed by B diffusing into the hard phase. This structure makes the coarse particles have both a high hardness and a lubricating action so as to be significantly useful particularly under an intense environment of adhesive wear. In FIG. 1B, reference numeral 1 denotes a base phase mainly comprising the Cu based alloy powder, reference numeral 2 denotes a hard phase mainly comprising the Fe or Co based alloy powder, reference numeral 3 denotes the Mo-based boride in a shell shape, and reference numeral 4 denotes the Mo-based boride resulting from diffusion of B into the Fe or Co based alloy powder.

(3) It is known that the magnitude of the coarseness of the hard phase as well as the base hardness of the Cu base has an effect on the improvement of the wear resistance of the laser clad valve seat. According to Japanese Patent Publication No. 942/1996, the distribution of the coarse hard particles remaining solidified in the cladding layer is achieved by the use of a composition initiating liquid-phase separation. Specifically, a molten metal initiates a liquid-phase separation by including an element having a high propensity to initiate liquid-phase separation from Cu, such as Cr, Mo, W, V, Nb, Ta, B, C and the like. The liquid phase materials resulting from the liquid separation are solidified and coarser one of the separated liquid phase materials is scattered as hard particles.

However, in this conventional method it is difficult to control the size of the coarse particles due to variations in cooling speed and variations in the agitated state of the molten bead (pool). If the particle size is extremely small, the wear resistance is impaired, but if it is extremely coarse, the finishing property is impaired. As described above, the present invention produces coarse hard particles with the shell structure of the Fe or Co based alloy powder and the Mo based boride formed by the reaction. However, the shell-shaped Mo based boride (high melting point) formed at the interface serves as a barrier, so that any reaction between the Cu based alloy powder and the Fe or Co based alloy powder is inhibited after the Mo based boride has been formed at a high temperature. As a result, the size of the coarse particles having a shell structure is determined approximately by the particle diameter of the mixed Fe or Co based alloy powder, so that the size control for the coarse hard particle is facilitated.

(4) In general, the presence of coarse hard particles impairs the machine finish property. However, the cladding material of the present invention exhibits satisfactory property of machine finish on the surface in spite of the scattering of coarse hard particles of approximately some hundreds of μm. The reasons for this are estimated as follows. If coarse hard particles are present, the coarse hard particles cause wear or damage to the cutting edge of the cutter in the machining process. For this reason, the surface machined by the cutting edge is of inferior finished quality. It is estimated that because the coarse hard particles according to the present invention are covered with the Mo based boride having a satisfactory lubricating effect, the lubricating effect results in less wear and damage on the mating material, thus preventing wear from occurring on the cutting edge of the cutter thus improving the surface finishing property.

(5) Fe or Co is used as the base metal of the Fe or Co based alloy powder serving as a Mo source in the present invention. However, Fe and Co are not easily diffused into the molten Cu, and because Mo is included, are even less easily diffused. In addition, as described in item (3), since the shell-shaped Mo based boride formed at a high temperature on the interface of the Fe or Co based alloy powder functions as a barrier, the elements included in the Fe or Co based alloy powder are far less likely to be diffused in the molten metal of the Cu based alloy powder. As a result, the composition of the Cu based alloy powder will not lose the satisfactory cladding property that it inherently possesses. If the Fe or Co based alloy powder is replaced by an alloy based on Ni which is 100% soluble with Cu, a certain amount of Ni is diffused in the molten metal of the Cu based alloy powder before the barrier of the shell-shaped Mo based boride is formed, resulting in impairment of the cladding property of the Cu based alloy powder.

In this connection, if a predetermined amount of Mo is added to the Cu based alloy powder in order to form Mo based boride, the molten metal of the Cu based alloy powder containing Mo and B crystallizes the Mo based boride at an extremely high temperature. As a result, in the atomizing process, ultra-coarse crystallized particles are formed, leading to a tendency to block the nozzle. In addition, even if the atomizing process can manage to be performed, the molten metal has a high viscosity such as to deteriorate the cladding property while the ultra-coarse crystallized particles deteriorate the finishing property. Further, unlike the present invention, the shell-shaped Mo based boride is not formed in shell form on the interface with the Fe or Co based alloy powder, and accordingly the advantageous effects described in items (2) to (4) are not offered. In consequence, the present invention totally differs from a technique using a single alloy powder rather than a mixture, even if the same components are used.

Cu Based Alloy Powder

The raw-material powder of the present invention comprises a Cu based alloy powder of 80 to 99% by weight. The Cu based alloy powder comprises 0.5 to 5% by weight of B, 0 to 20% by weight of Ni, 0 to 10% by weight of Fe plus Co, 0 to 5% by weight of Si, 0 to 3% by weight of Al, and the balance Cu and unavoidable impurities. According to a preferred embodiment of the present invention, the Cu based alloy powder preferably comprises 0.5 to S % by weight of B, 7 to 20% by weight of Ni, up to 10% by weight of Fe plus Co, 2 to 5% by weight of Si, up to 3% by weight of Al, and the balance Cu and unavoidable impurities. Such Cu based alloy powder exhibits a superior cladding property.

In the cladding material in the present invention, B is an essential component for reacting with the Mo included in the Fe or Co based alloy powder to form Mo based boride. Less than 0.5% by weight of B leads to insufficient formation of the Mo based boride, while more than 5% by weight of B deteriorates the cladding property, for example, the base mainly comprising the Cu based alloy powder becomes brittle to cause cracks in the cladding. In consequence, the Cu based alloy powder used in the present invention comprises 0.5 to 5% by weight of B, preferably 1 to 3% by weight of B.

According to a preferred embodiment of the present invention, the Cu based alloy powder preferably comprises 7 to 20% by weight of Ni, more preferably 10 to 17% by weight of Ni. Ni has the effects of increasing the hardness and improving the wear resistance. 7% by weight or more of Ni effectively produces these effects, while more than of 20% by weight of Ni deteriorates the cladding property.

According to a preferred embodiment of the present invention, the Cu based alloy powder preferably comprises up to 10% by weight of Fe and Co, more preferably 2 to 7% by weight of Fe and Co. Fe and Co resemble each other in behavior in the Cu alloy, so that only the total amount needs to be taken into consideration. Fe and Co have the effects of increasing the hardness and improving the wear resistance, while more than 10% by weight of Fe and Co deteriorates the cladding property.

According to a preferred embodiment of the present invention, the Cu based alloy powder preferably comprises 2 to 5% by weight of Si, more preferably 3 to 5% by weight of Si. Si has the effects of increasing the hardness and improving the wear resistance. 2% by weight or more of Si effectively produces these effects, while more than of 5% by weight of Si deteriorates the cladding property.

According to a preferred embodiment of the present invention, the Cu based alloy powder preferably comprises up to 3% by weight of Al, more preferably 0.1 to 1% by weight of Al. Al is an element which increases the hardness and improves the wear resistance, while more than of 3% by weight of Al deteriorates the cladding property.

The Cu based alloy powder used in the present invention comprises Cu as the balance. While the laser clad valve seat is built up by the cladding on the cylinder head made mainly of an aluminum alloy, the use of Cu for the base alloy leads to a superior weldability to Al. As a result, the Cu based alloy powder has a satisfactory cladding property and the clad layer can function as the base.

The raw-material powder of the present invention comprises the Cu based alloy powder of 80 to 99% by weight, preferably 85 to 96% by weight, and more preferably 85 to 95% by weight. Less than 80% by weight of the Cu based alloy powder deteriorates the cladding property, while more than 99% by weight of the Cu based alloy powder deteriorates the wear resistance.

Fe or Co Based Alloy Powder

The raw-material powder of the present invention comprises an Fe or Co based alloy powder 1 to 20% by weight. The Fe or Co based alloy powder comprises 5 to 40% by weight of Mo, 0 to 25% by weight of Cr, 0 to 5% by weight of Si, and the balance Fe or Co and unavoidable impurities. According to a preferred embodiment of the present invention, the Fe or Co based alloy powder is preferably a Co based alloy powder comprising 5 to 40% by weight of Mo, up to 25% by weight of Cr, up to 5% by weight of Si, and the balance Co and unavoidable impurities.

In the cladding material in the present invention, Mo is an essential component for reacting with the B included in the Cu based alloy powder to form Mo based boride. Less than 5/by weight of Mo leads to insufficient formation of the Mo based boride, while more than 40% by weight of Mo causes a rise in melting point of the Fe or Co based alloy powder to make the atomizing process difficult. In consequence, the Mo content is set in a range from 5 to 40% by weight. Preferably, it ranges from 10 to 30% by weight.

According to a preferred embodiment of the present invention, the Fe or Co based alloy powder desirably comprises up to 25% by weight of Cr, preferably 5 to 20% by weight of Cr; more preferably 10 to 20% by weight of Cr. Cr has the effects of increasing the hardness and improving the wear resistance. More than 25% by weight of Cr causes a rise in melting point of the Fe or Co based alloy powder, to make the atomizing process difficult.

According to a preferred embodiment of the present invention, the Fe or Co based alloy powder desirably comprises up to 5% by weight of Si, preferably up to 3% by weight of Si. Si has the effects of increasing the hardness and improving the wear resistance. In the case of more than 5% by weight of Si, the coarse hard particles mainly comprising the Fe or Co based alloy powder in the clad layer become brittle, so that the brittle coarse hard particles fall away in the finishing process to deteriorate the finishing property.

The Fe or Co based alloy powder used in the present invention comprises Fe or Co as the balance, preferably Co as the balance. Because the melting points of Fe and Co are relatively low, Fe and Co can be melted by the laser cladding technique. In addition, the Fe and Co have low reactivity with Cu, so that the Fe and Co are not diffused into the molten metal of the Cu based alloy powder more than necessary. As a result, the Cu based alloy powder will not lose the satisfactory cladding property that it inherently possesses. Also, even if the Mo which is an essential element of the present invention is added up to 40% by weight, it is possible to lower the melting point to a degree (about 1600° C.) at which the atomizing process can be performed. Its amount to be mixed has an effect on the amount of shell-shaped coarse hard particles.

The raw-material powder of the present invention comprises the Fe or Co based alloy powder of 1 to 20% by weight, preferably 4 to 15% by weight. Less than 1% by weight of the Fe or Co based alloy powder deteriorates the wear resistance because of an insufficient amount of coarse hard particles, while more than 20% by weight makes the clad layer brittle to deteriorate the cladding property, for example, cracks caused in the cladding.

The Fe or Co based alloy powder used in the present invention has a Vickers hardness of 500 HV or higher, preferably 600 to 850 HV, more preferably 750 to 850 HV. In the present invention, in the Fe or Co based alloy powder comprising Mo, part of the Mo which is an additional element reacts with B to form Mo based boride, and also in the cladding material, most of the Fe or Co based alloy powder remains in the shell-shaped coarse hard particles with approximately the same composition as that of the Fe or Co based alloy powder which is the original raw-material powder. Accordingly, the hardness of the Fe or Co based alloy powder itself affects the hardness of the coarse hard particles in the clad layer. However, when the Vickers hardness of the Fe or Co based alloy powder is less than 500 HV, it is difficult to achieve 500 HV or higher of the hardness of the coarse hard particle in the clad layer, leading to insufficient wear resistance.

The Fe or Co based alloy powder used in the present invention has an average particle diameter of 50 to 200 μm; preferably 65 to 150 μm, more preferably 70 to 120 μm. In the present invention, "average particle diameter" means an average particle diameter (D50) on a number basis. The average particle diameter of the Fe or Co based alloy powder in the present invention affects the size of the shell-shaped coarse hard particle and the weldability in the laser cladding process. When the average particle diameter of the Fe or Co based alloy powder is less than 50 μm, the size of the shell-shaped coarse hard particle become small, resulting in insufficient effect of improving the wear resistance. More than 200 μm of the average particle diameter of the Fe or Co based alloy powder causes insufficient melting of the Fe or Co based alloy powder in the laser cladding process, deteriorating the cladding property.

Laser Clad Valve Seat

The laser clad valve seat according to the present invention comprises a laser clad layer formed by laser-cladding with the powder mixture. In the clad layer, there are formed a phase mainly comprising the Fe or Co based alloy powder and a structure in which the shell-shaped Mo based boride surrounds the Mo based boride formed by diffusing B into the phase. This structure makes the coarse particles have both high hardness and lubricating action so as to be significantly useful under an intense environment of adhesive wear. The wear resistance and the finishing property can be simultaneously improved.

According to a preferred embodiment of the present invention, the laser clad layer preferably contains coarse particles, and the coarse particles preferably have a shell structure in which Mo based boride surrounds a phase mainly comprising an Fe or Co based alloy comprising 5 to 40% by weight of Mo, 0 to 25% by weight of Cr, 0 to 5% by weight of Si, and the balance Fe or Co and unavoidable impurities. According to a more preferred embodiment of the present invention, the phase mainly comprising the Fe or Co based alloy preferably comprises 5 to 40% by weight of Mo, up to 25% of Cr up to 5% by weight of Si, and the balance Co and unavoidable impurities.

According to a preferred embodiment of the present invention, the coarse particle preferably has a Vickers hardness of 500 HV or higher, more preferably 600 to 900 HV. The hardness of the coarse particles affects the wear resistance, and a hardness of 500 HV or greater enhances this effect.

According to a preferred embodiment of the present invention, the coarse particle preferably has an average particle diameter of 30 to 300 μm, preferably 150 to 250 μm, more preferably 100 to 250 μm. The size of the coarse particle also affects the wear resistance. A diameter of 30 μm or larger enhances this effect, while a diameter of more than 300 μm deteriorates the finishing property.

EXAMPLES

The present invention will be described below in detail with examples.

Example I

The base materials each having a weight of 1.5 kg, shown in Tables I-1 and I-2, were melted and then subjected to the Ar atomizing process to independently produce Cu based alloy powders and Fe or Co based alloy powders. The Cu based alloy powders were classified to obtain a size of 150/63 μm and the Fe or Co based alloy powders respectively were classified to obtain an average particle diameter shown in Table I-2. Then, the Cu based alloy powders and the Fe or Co based alloy powders were mixed together. With the resultant powder mixtures, a laser cladding was conducted in a circular shape onto the Al substrate having a groove with a width of 4 mm and a depth of 2 mm formed therein, and then this substrate was cut into a valve seat shape and polished. The resultant work piece was heated at 150° C. and subjected to an evaluation of the degree of wear caused by the valve (A/F (Air/Fuel) ratio=14.7).

Table I-3 shows the powder mixing conditions, and the hardness and the diameter of each of the coarse particles with the shell structure. The diameter of the coarse particle was measured through image analysis using the optical microscope photograph for samples of the polished clad materials. The laser cladding conditions are as follows:

Laser output: 1.5 kW
Laser shape: rectangle
Feed rate of powder: 50 g/min.
Feeding speed: 8 mm/s
Atmosphere: Ar atmosphere (1) Cladding property: This was evaluated based on a vertical to horizontal ratio of cross-section of clad bead and the presence/absence of a cladding crack as described below.
O: Height/width≦0.6, with no cladding crack
X: Height/width>0.6, and/or, with cladding clacks (2) Wear resistance: This was evaluated based on a depth of a wear on the valve seat after the wear evaluation as described below.
O: Wear depth≦60 μm
X: Wear depth>60 μm (3) Finishing property: This was evaluated based on the surface roughness after the process of polishing into a valve seat shape as described below.
O: Average roughness Ra≦0.2 μm
X: Average roughness Ra>0.2 μm

TABLE I-1

| | Component Composition (wt %) | | | | | | | | |
|---|---|---|---|---|---|---|---|---|---|
| No. | Ni | Fe | Co | Si | Al | Mn | B | Cu | |
| A-1 | 10 | 4 | 4 | 3 | — | 3 | 0.5 | Balance | Examples |
| A-2 | 15 | 2 | 4 | 3 | 0.2 | — | 2 | Balance | |
| A-3 | 20 | 1 | 4 | 2 | 0.5 | — | 5 | Balance | |
| A-4 | 10 | — | — | 3 | 0.5 | — | 3 | Balance | |
| A-5 | 15 | 3 | — | 2 | 1 | 2 | 4 | Balance | |
| A-6 | 10 | 3 | — | 2 | 1 | — | 6 | Balance | Comparative |
| A-7 | 25 | 3 | 1 | 2 | 0.2 | — | — | Balance | Examples |

Underlined numerals fall outside the range of the present invention.

TABLE I-2

| No. | Compound Composition (wt %) Ni | Mo | Cr | Si | B | C | Fe | Co | Vickers Hardness (HV) | Average Diameter (μm) | |
|---|---|---|---|---|---|---|---|---|---|---|---|
| B-1 | — | 25 | 10 | 5 | 0.5 | — | Bal | — | 1000 | 50 | Examples |
| B-2 | — | 5 | 25 | — | — | — | Bal | 10 | 500 | 200 | |
| B-3 | — | 10 | 15 | — | — | — | Bal | 10 | 800 | 80 | |
| B-4 | 10 | 40 | — | — | — | — | 10 | Bal | 600 | 150 | |
| B-5 | — | 30 | 10 | 2 | — | — | — | Bal | 750 | 100 | |
| B-6 | Bal | 35 | 10 | — | 1.5 | — | — | — | 650 | 100 | |
| B-7 | 10 | 40 | — | — | — | — | 10 | Bal | 600 | 300 | Comparative |
| B-8 | 20 | 5 | 15 | — | — | — | — | Bal | 400 | 100 | Examples |
| B-9 | — | 3 | 25 | 3 | — | — | Bal | — | 550 | 150 | |
| B-10 | 10 | 40 | — | — | — | — | 10 | Bal | 600 | 30 | |

Underlined numerals fall outside the range of the present invention; Bal: balance

TABLE I-3

| No | Powder (A) | Powder (B) | Powder A Content (wt %) | Powder B Content (wt %) | Hardness of Shell-Structure Coarse Particles (HV) | Diameter of Shell-Structure Coarse Particles (μm) | Cladding Property | Wear Resistance | Finishing Property | |
|---|---|---|---|---|---|---|---|---|---|---|
| 1 | A-4 | B-1 | 80 | 20 | 1300 | 30 | ○ | ○ | ○ | Examples |
| 2 | A-4 | B-2 | 90 | 10 | 500 | 300 | ○ | ○ | ○ | |
| 3 | A-4 | B-3 | 95 | 5 | 800 | 50 | ○ | ○ | ○ | |
| 4 | A-4 | B-4 | 99 | 1 | 1500 | 250 | ○ | ○ | ○ | |
| 5 | A-4 | B-5 | 90 | 10 | 1200 | 200 | ○ | ○ | ○ | |
| 6 | A-4 | B-6 | 90 | 10 | 800 | 100 | X | ○ | X | Comp. |
| 7 | A-4 | B-7 | 90 | 10 | 900 | 350 | X | ○ | X | Examples |
| 8 | A-4 | B-8 | 90 | 10 | 450 | 150 | ○ | X | ○ | |
| 9 | A-4 | B-9 | 90 | 10 | No shell structure | No shell structure | ○ | X | X | |
| 10 | A-4 | B-10 | 90 | 10 | 950 | 20 | ○ | X | ○ | |
| 11 | A-1 | B-4 | 85 | 15 | 750 | 150 | ○ | ○ | ○ | Examples |
| 12 | A-2 | B-4 | 80 | 20 | 1000 | 200 | ○ | ○ | ○ | |
| 13 | A-3 | B-4 | 90 | 10 | 1100 | 100 | ○ | ○ | ○ | |
| 14 | A-5 | B-4 | 95 | 5 | 1100 | 150 | ○ | ○ | ○ | |
| 15 | A-6 | B-4 | 85 | 15 | 1100 | 100 | X | ○ | ○ | Comp. |
| 16 | A-7 | B-4 | 90 | 10 | No shell structure | No shell structure | ○ | X | X | Examples |
| 17 | A-4 | B-4 | 99.5 | 0.5 | 750 | 150 | ○ | X | ○ | |
| 18 | A-4 | B-4 | 75 | 25 | 850 | 100 | X | ○ | ○ | |
| 19 | A-3 | B-1 | 99.5 | 0.5 | 1000 | 20 | ○ | X | ○ | |

Underlined numerals fall outside the range of the present invention.

Table I-1 shows the compositions of the Cu based alloy powders comprising B, in which Nos. A-1 to A-5 are examples of the present invention while Nos. A-6 and A-7 are comparative examples. Table I-2 shows the compositions of the Fe or Co based alloy powders comprising Mo, in which Nos. B-1 to B-5 are examples of the present invention while Nos. B-6 to B-10 are comparative examples. As another comparative example, Co(balance)-10Fe-10Ni-45Mo was attempted to be produced by atomizing, but part of the Mo base material remained without being melted.

Table 1-3 shows the mixing conditions, the hardness and the diameter of the shell-structure coarse particle, the cladding property, the wear resistance, and the finishing property. Samples 1 to 5 and 11 to 14 are examples of the present invention, while samples 6 to 10 and 15 to 19 are comparative examples. In sample 6, the laser cladding property and the finishing property were poor because the component composition of the Fe or Co based alloy powder which is the mixing powder (B) is based on Ni. In sample 7, the diameter of the shell-structure coarse particles was large because of a large average particle diameter of the Fe or Co based alloy powder, which is the mixing powder (B), resulting in poor cladding property and poor finishing property.

In sample 8, the wear resistance was poor because of a low hardness of the shell-structure coarse particle of the Fe or Co based alloy powder, which is the mixing powder (B). In sample 9, the wear resistance and the finishing property were poor because the Fe or Co based alloy powder, which is the mixing powder (B), has a low Mo content so as not to form a shell structure of the Mo based boride. In sample 10, the diameter of the shell-structure coarse particle was small because of a small average particle diameter of the Fe or Co based alloy powder, which is the mixing powder (B), resulting in poor wear resistance.

In sample 15, the cladding property was poor because the Cu based alloy powder, which is the mixing powder (A), has a high B content. In sample 16, the wear resistance and the finishing property were poor because B is not included in the Cu based alloy powder, which is the mixing powder (A), failing to produce shell-structure coarse particles. In sample 17, the wear resistance was poor because of a low mixing amount of the Fe or Co based alloy powder, which is the mixing powder (B).

In sample 18, the cladding property was poor because of a high mixing amount of the Fe or Co based alloy powder, which is the mixing powder (B). In sample 19, the wear resistance was poor because of a low mixing amount of the Fe or Co based alloy powder, which is the mixing powder (B), and a small diameter of the shell-structure coarse particle. Although a production through atomizing was attempted by using as a single alloy the compositions of the samples 1, 5 and 13, which are examples of the present invention, the nozzle was blocked in any case to be unable to produce them by atomizing. In contrast, it is seen that samples 1 to 5 and 11 to 14, which are examples of the present invention, are superior in cladding property, wear resistance, and finishing property because all of them satisfy the conditions of the present invention.

Example II

The base materials having a weight of 1.5 kg, shown in Tables II-1, were melted and then subjected to the Ar atomizing process to independently produce Cu based alloy powders and Co based alloy powders. The Cu based alloy powders shown in Table II-1 respectively were classified to obtain a size of 150/63 μm and the Co based alloy powders respectively were classified to obtain a D50 average particle diameter shown in Table II-2. Then, the Cu based alloy powders and the Co based alloy powders were mixed together. With the resultant powder mixtures, a laser cladding was conducted in a circular shape onto the Al substrate having a groove with a width of 4 mm and a depth of 2 mm formed therein, and then this substrate was cut into a valve seat shape and polished. The resultant work piece was heated at 150° C. and subjected to an evaluation of the degree of wear caused by the valve (A/F ratio=14.7).

Tables II-1 and II-2 show the powder mixing conditions, and the hardness and the diameter of each of the coarse particles having the shell structure. The diameter of the coarse particle was measured through image analyses using the optical microscope photograph for the polished clad materials and converted to a diameter of the corresponding circle.

The results are shown in Table II-2. The laser cladding conditions are as follows.

Laser output: 1.5 kW

Laser shape: rectangle

Feed rate of powder: 50 g/min.

Feeding speed: 8 mm/s

Atmosphere: Ar atmosphere (1) Cladding property: This was evaluated based on a vertical to horizontal ratio of cross-section of clad bead and the presence/absence of a cladding crack as described below.

O: Height/width ≦0.6, with no cladding crack

X: Height/width >0.6, and/or, with cladding cracks (2) Wear resistance: This was evaluated based on a depth of a wear on the valve seat after the wear evaluation as described below.

Wear depth ≦60 μm

Wear depth >60 μm (3) Finish property: This was evaluated based on the surface roughness after the process of polishing into a valve seat shape as described below.

O: Average roughness Ra ≦0.2 μm

X: Average roughness Ra >0.2 μm

TABLE II-1

| | Cu Based Alloy Powder (wt %) | | | | | | | Co Based Alloy Powder (wt %) | | | | | | Cu Based Alloy Powder | Co Based Alloy Powder | |
|---|---|---|---|---|---|---|---|---|---|---|---|---|---|---|---|---|
| No. | Ni | Fe | Co | Si | Al | B | Cu | Mo | Cr | Si | Co | HV | D50 | (wt %) | (wt %) | |
| 1 | 10 | — | — | 3 | 0.5 | 3 | Bal | 40 | — | — | Bal | 600 | 50 | 80 | 20 | Examples |
| 2 | 10 | — | — | 3 | 0.5 | 3 | Bal | 5 | 25 | 3 | Bal | 700 | 100 | 85 | 15 | |
| 3 | 10 | — | — | 3 | 0.5 | 3 | Bal | 20 | 10 | 2 | Bal | 650 | 200 | 90 | 10 | |
| 4 | 10 | — | — | 3 | 0.5 | 3 | Bal | 10 | 10 | 5 | Bal | 850 | 150 | 99 | 1 | |
| 5 | 10 | — | — | 3 | 0.5 | 3 | Bal | 4 | 20 | 1 | Bal | 500 | 100 | 85 | 15 | Comparative |
| 6 | 10 | — | — | 3 | 0.5 | 3 | Bal | 20 | 10 | 6 | Bal | 1000 | 150 | 90 | 10 | Examples |
| 7 | 10 | — | — | 3 | 0.5 | 3 | Bal | 5 | 15 | — | Bal | 400 | 200 | 85 | 15 | |
| 8 | 10 | — | — | 3 | 0.5 | 3 | Bal | 5 | 25 | 3 | Bal | 700 | 30 | 90 | 10 | |
| 9 | 10 | — | — | 3 | 0.5 | 3 | Bal | 5 | 25 | 3 | Bal | 700 | 300 | 90 | 10 | |
| 10 | 7 | 5 | 5 | 3 | 1 | 2 | Bal | 20 | 10 | 2 | Bal | 650 | 200 | 95 | 5 | Examples |
| 11 | 10 | 1 | 1 | 5 | — | 1 | Bal | 20 | 10 | 2 | Bal | 650 | 200 | 95 | 5 | |
| 12 | 10 | 1 | 1 | 2 | 3 | 0.5 | Bal | 20 | 10 | 2 | Bal | 650 | 200 | 95 | 5 | |
| 13 | 15 | 2 | 4 | 3 | 0.2 | 2 | Bal | 20 | 10 | 2 | Bal | 650 | 200 | 90 | 10 | |
| 14 | 20 | 1 | 4 | 2 | 0.5 | 5 | Bal | 20 | 10 | 2 | Bal | 650 | 200 | 90 | 10 | |
| 15 | 6 | 2 | 2 | 2 | 1 | 2 | Bal | 20 | 10 | 2 | Bal | 650 | 200 | 95 | 5 | |
| 16 | 25 | 1 | 1 | 2 | 1 | 2 | Bal | 20 | 10 | 2 | Bal | 650 | 200 | 90 | 10 | Comparative |
| 17 | 10 | 4 | 8 | 2 | — | 3 | Bal | 20 | 10 | 2 | Bal | 650 | 200 | 90 | 10 | Examples |
| 18 | 15 | 2 | 2 | 1 | 1 | 1 | Bal | 20 | 10 | 2 | Bal | 650 | 200 | 90 | 10 | Example |
| 19 | 10 | 3 | 3 | 6 | 2 | 2 | Bal | 20 | 10 | 2 | Bal | 650 | 200 | 95 | 5 | Comparative |
| 20 | 15 | 2 | 4 | 3 | 4 | 3 | Bal | 20 | 10 | 2 | Bal | 650 | 200 | 95 | 5 | Examples |
| 21 | 10 | 3 | 3 | 2 | 1 | 0.3 | Bal | 20 | 10 | 2 | Bal | 650 | 200 | 95 | 5 | |
| 22 | 15 | 3 | 6 | 2 | 1 | 6 | Bal | 20 | 10 | 2 | Bal | 650 | 200 | 95 | 5 | |
| 23 | 10 | — | — | 3 | 0.5 | 3 | Bal | 20 | 10 | 2 | Bal | 650 | 200 | 75 | 25 | |
| 24 | 10 | — | — | 3 | 0.5 | 3 | Bal | 20 | 10 | 2 | Bal | 650 | 200 | 99.5 | 0.5 | |

Underlined numerals fall outside the range of the present invention; Bal: balance

TABLE II-2

| No. | Shell-Structure Coarse Particle Hardness (HV) | Shell-Structure Coarse Particle Diameter (μm) | Cladding Property | Wear Resistance | Finishing Property | |
|---|---|---|---|---|---|---|
| 1 | 800 | 30 | ○ | ○ | ○ | Examples |
| 2 | 850 | 150 | ○ | ○ | ○ | |
| 3 | 600 | 300 | ○ | ○ | ○ | |
| 4 | 900 | 150 | ○ | ○ | ○ | |
| 5 | No shell structure | No shell structure | ○ | X | X | Comp. Examples |
| 6 | 1250 | 150 | X | ○ | X | |
| 7 | 450 | 250 | ○ | X | ○ | |
| 8 | 900 | 20 | ○ | X | ○ | |
| 9 | 700 | 350 | X | ○ | X | |
| 10 | 750 | 200 | ○ | ○ | ○ | Examples |
| 11 | 800 | 200 | ○ | ○ | ○ | |
| 12 | 700 | 200 | ○ | ○ | ○ | |
| 13 | 900 | 250 | ○ | ○ | ○ | |
| 14 | 800 | 150 | ○ | ○ | ○ | |
| 15 | 750 | 200 | ○ | X | ○ | |
| 16 | 700 | 200 | X | ○ | ○ | Comp. |
| 17 | 800 | 250 | X | ○ | X | Examples |
| 18 | 900 | 200 | ○ | X | ○ | Example |
| 19 | 800 | 254 | X | ○ | X | Comp. |
| 20 | 800 | 200 | X | ○ | ○ | Examples |
| 21 | No shell structure | No shell structure | ○ | X | X | |
| 22 | 1000 | 150 | X | ○ | ○ | |
| 23 | 700 | 200 | X | ○ | ○ | |
| 24 | 750 | 150 | ○ | X | ○ | |

As shown in Tables II-1 and II-2, samples 1 to 4, 10 to 15, and 18 are examples of the present invention while samples 5 to 9, 16, 17, and 19 to 24 are comparative examples.

In sample 5, the wear resistance and the finishing property were poor because the Co based alloy powder has a low content of Mo, which is a component composition, failing to form a shell structure. In sample 6, the cladding property and the finishing property were poor because the Co based alloy powder has a high content of Si, which is a component composition thereof, to increase the hardness of the Co based alloy powder. In sample 7, the wear resistance was poor because of a low hardness of the Co based alloy powder and thus a low hardness of the shell-structure coarse particles in the clad layer. In sample 8, the wear resistance was poor because of a small average particle diameter of the Co based alloy powder and thus a small diameter of the shell-structure of the coarse particle. In sample 9, the cladding property and the finishing property were poor because of a large average particle diameter of the Co based alloy powder and thus a large diameter of the shell-structure coarse particles in the clad layer.

In sample 16, the cladding property was poor because the Cu based alloy powder has a high content of Ni, which is a component composition thereof. In sample 17, the cladding property and the finishing property were poor because the Cu based alloy powder has a high total content of Fe and Co, which are component compositions thereof. In sample 19, the cladding property and the finishing property were poor because the Cu based alloy powder has a high content of Si, which is a component composition thereof.

In sample 20, the cladding property was poor because the Cu based alloy powder has a high Al content, which is a component composition thereof. In sample 21, the wear resistance and the finishing property were poor because the Cu based alloy powder has a low B content, which is a component composition thereof, failing to form a shell-structure. In sample 22, the cladding property was poor because the Cu based alloy powder has a high B content which is a component composition thereof. In sample 23, the cladding property was poor because the Cu based alloy powder was mixed at a low ratio while the Co based alloy powder was mixed at a high ratio.

In sample 24, the wear resistance was poor because the Cu based alloy powder was mixed at a high ratio while the Co based alloy powder was mixed at a low ratio in contrast to sample 23. As another comparative example of the Co based alloy powder, a production through atomizing was attempted by using the component compositions of 45Mo-5Cr-balance Co and 10Mo-30Cr-1Si-balance Co, but part of Mo and Cr base materials remained without being melted. In contrast, it is seen that samples 1 to 4 and 10 to 14, which are examples of the present invention, are superior in cladding property, wear resistance, and finishing property because all of them satisfy the conditions of the present invention.

The invention claimed is:

1. A raw-material powder for a laser clad valve seat, comprising a powder mixture of:

a Cu based alloy powder of 80% to 99% by weight of the powder mixture comprising:
B: 0.5 to 5% by weight,
Ni: 0 to 20% by weight,
Fe plus Co: 0 to 10% by weight,
Si: 0 to 5% by weight,
Al: 0 to 3% by weight, and
the balance Cu and unavoidable impurities; and an Fe or Co based alloy powder of 1 to 20% by weight of the powder mixture, having a Vickers hardness of 500 HV or higher and an average particle diameter of 50 to 200 μm and comprising:
Mo: 5 to 40% by weight, Cr: 0 to 25% by weight,
Si: 0 to 5% by weight, and
the balance Fe or Co and unavoidable impurities.

2. The raw-material powder according to claim 1, wherein the Cu based alloy powder comprises:

B: 0.5 to 5% by weight,
Ni: 7 to 20% by weight,
Fe plus Co: up to 10% by weight,
Si: 2 to 5% by weight,
Al: up to 3% by weight, and
the balance Cu and unavoidable impurities, and the Fe or Co based alloy powder comprises:
Mo: 5 to 40% by weight,
Cr: up to 25% by weight,
Si: up to 5% by weight, and
the balance Co and unavoidable impurities.

3. A laser clad valve seat comprising a laser clad layer formed by laser-cladding with the powder mixture according to claim 1.

4. The laser clad valve seat according to claim 3, wherein the laser clad layer contains coarse particles, and the coarse particle has a shell structure in which Mo based boride surrounds a phase mainly comprising an Fe or Co based alloy comprising 5 to 40% by weight of Mo, 0 to 25% by weight of Cr, 0 to 5% by weight of Si, and the balance Fe or Co and unavoidable impurities.

5. The laser clad valve seat according to claim 4, wherein the phase mainly comprising the Fe or Co based alloy comprise 5 to 40% by weight of Mo, up to 25% by weight of Cr, up to 5% by weight of Si, and the balance Co and unavoidable impurities.

6. The laser clad valve seat according to claim 4, wherein the coarse particle has a Vickers hardness of 500 HV or higher and an average particle diameter of 30 to 300 μm.

7. A laser clad valve seat comprising a laser clad layer formed by laser-cladding with the powder mixture according to claim 2.

8. The laser clad valve seat according to claim 7, wherein the laser clad layer contains coarse particles, and the coarse particle has a shell structure in which Mo based boride surrounds a phase mainly comprising an Fe or Co based alloy comprising 5 to 40% by weight of Mo, 0 to 25% by weight of Cr, 0 to 5% weight of Si, and the balance Fe or Co and unavoidable impurities.

9. The laser clad valve seat according to claim 8, wherein the phase mainly comprising the Fe or Co based alloy comprise 5 to 40% by weight of Mo, up to 25% by weight of Cr, up to 5% by weight of Si, and the balance Co and unavoidable impurities.

10. The laser clad valve seat according to claim 9, wherein the coarse particle has a Vickers hardness of 500 HV or higher and an average particle diameter of 30 to 300 μm.

11. The laser clad valve seat according to claim 5, wherein the coarse particle has a Vickers hardness of 500 HV or higher and an average particle diameter of 30 to 300 μm.

* * * * *